United States Patent [19]

Salomon

[11] 4,455,768

[45] Jun. 26, 1984

[54] SKI BOOT WITH FLEX CONTROL

[75] Inventor: Georges P. J. Salomon, Annecy, France

[73] Assignee: Etablissements Francois Salomon Et Fils S.A., Annecy, France

[21] Appl. No.: 255,176

[22] Filed: Apr. 17, 1981

[30] Foreign Application Priority Data

Apr. 17, 1980 [FR] France ..... 80 08948
Jun. 18, 1980 [FR] France ..... 80 13822

[51] Int. Cl.[3] ..... A43B 5/04
[52] U.S. Cl. ..... 36/121
[58] Field of Search ..... 36/117, 118, 119, 120, 36/121, 50

[56] References Cited

U.S. PATENT DOCUMENTS 3,832,792 9/1974 Kastinger .
4,095,356 6/1978 Robran et al. ..... 36/121
4,282,658 11/1981 Hanson et al. ..... 36/121
4,317,297 3/1982 Hanson ..... 36/121

FOREIGN PATENT DOCUMENTS 329407 5/1976 Austria .
2037248 7/1970 Fed. Rep. of Germany .
2410515 3/1974 Fed. Rep. of Germany .
2730364 1/1978 Fed. Rep. of Germany .
2103171 4/1972 France .
2256734 8/1975 France .
2371162 6/1978 France .

*Primary Examiner*—Patrick D. Lawson
*Attorney, Agent, or Firm*—Sandler & Greenblum

[57] ABSTRACT

The ski boot of the invention comprises a shank and a rigid shell base. The shank is at least partially journalled on the shell base, and flexion means for adjusting the flexional characteristics of the shank relative to the shell base are also provided. The flexion means is generally positioned at the lower portion of the shank and comprises:

(a) first support means associated with the shank;
(b) second support means associated with the shell base, the first and second support means forming at least one groove therebetween; and
(c) transmission means for transmitting flexional forces exerted by the leg of a skier on the shank from the first support means to the second support means.

46 Claims, 28 Drawing Figures

SKI BOOT WITH FLEX CONTROL

BACKGROUND OF THE INVENTION

1. Field of the Invention

The present invention relates to shoes or boots adapted for use in skiing which are of the type essentially formed out of a shell base molded to fit around the foot. Such boots further comprise a shank which is likewise molded in one or more portions to surround the bottom of the leg and is journalled on the shell base.

2. Description of Prior Art

Shoes or boots of the type described above have been known previously and different combinations have been utilized to give relatively rigid shoes or boots good flexional properties without sacrificing their purpose of transmitting the forces exerted on the boot as well as the control of the skis by the skier.

Constructions characteristic of this type of shoe or boot have been described in particular in French Pat. No. 2,096,248 wherein the problem of flexion between the journalled shank and the shell base has been resolved, for example, by providing a spring apparatus installed obliquely between the front of the shank and the top of the shell base. This system functions as a type of shock absorber which is adjustable according the needs of the skier.

Other designs have been developed such as are described in French patent application No. 2,276,851 where the flexion control is achieved by deformation in extension of the lower edge of a portion of the shank cooperating with the upper surface of a rigid shell base during frontward flexional movements of the leg of the skier.

German patent application No. 2,404,447 describes another type of apparatus for controlling the flexion of the shank of the shell base. In this instance, the device in question is provided at the rear of the shank. It consists of an elastic ring simultaneously surrounding a latching zone provided respectively on the shank and on the shell base. The elastic ring is extended as soon as the skier flexes forwardly. As a result, the flexion of the skier is controlled by the ring.

Finally, U.S. Pat. No. 3,848,347 describes a shoe or boot made of a shell and a rigid shank made out of plastic material comprising a vertical slit positioned along the longitudinal axis of the shoe or boot. This slit can be more or less biased to be spread depending on the positioning of a cursor maintaining the edges of this slit thereby allowing for variation of the flexion of the skier's leg as a function of the spacing of the slit obtained.

Furthermore, according to another known design, a shoe having its insertion opening at the rear comprises a shank, having a sort of opening transverse to the longitudinal axis of the shoe at the bottom of the rear portion of the shank. The lower edge of the shank serves as an extendably deformable band during the frontward flexions of the leg of the skier. In this type of system, the elasticity of the band is a function of the nature of the shank material.

However, the above solutions have not been completely satisfactory, in particular because they do not make it possible to actually provide a shank in which the flexional characteristics of the shank are adjustable and which are progressive depending upon the needs of the skier. Furthermore, the various constructions are either too heavy or voluminous, or rely upon interchangeable elements for modifying the flexional characteristics which are inconvenient for the skier.

In certain cases, the shoe or boot is adapted so as to require an opening of the shank along the front of the foot and at the bottom of the leg which results in entry of snow or water into the boot.

Furthermore, such systems require relatively flexible materials although a certain rigidity is also required, if only for laterally holding or securing the base of the leg. Such holding can only be achieved by increasing the thickness of the walls. This unfortunately results in an increase in the weight of the boot. Furthermore, in this type of construction, despite good shock absorption characteristics of the shank, the elastic return properties are very poor.

SUMMARY OF THE INVENTION

It is an object of the present invention to overcome the disadvantages noted above. It is a further object of the invention to provide a ski shoe or boot wherein the flexional characteristics of the shank with respect to the shell base are progressive and adjustable while nevertheless forbidding extreme flexions which would exceed the permissible limits of the anatomy of the leg-foot joint.

For this purpose, the present invention has as an object to provide a ski boot comprising a novel and particular means adapted to assure good flexional characteristics while preferably likewise taking into account the shock absorption and elastic return functions of the shank on the shell base of the shoe or boot.

Furthermore, the present invention further has an aim to provide a ski shoe or boot comprising novel and particular means adapted for the adjustment and control of the flexional characteristics the shank on the shell base.

Furthermore, another aim of the invention is to provide a ski shoe shank with which it is possible to provide good shock absorption of flexional stresses sustained together with elastic return sufficient for slight stresses by means of the control and adjustment apparatus.

The ski boot of the invention comprises a shank and a rigid shell base. The shank is at least partially journalled on the shell base, and flexion means for adjusting the flexional characteristics of the shank relative to the shell base are also provided. The flexion means is generally positioned at the lower portion of the shank and comprises:

(a) first support means associated with the shank;

(b) second support means associated with the shell base, the first and second support means forming at least one groove therebetween; and (c) transmission means for transmitting flexional forces exerted by the leg of a skier on the shank from the first support means to the second support means.

BRIEF DESCRIPTION OF THE DRAWINGS

Other objects and characteristics of the present invention will become clear from the detailed description which follows of the various embodiments of the invention, made with reference to the annexed drawings illustrating the invention in a non-limiting sense, in which.

DESCRIPTION OF PREFERRED EMBODIMENTS

Figure 1:
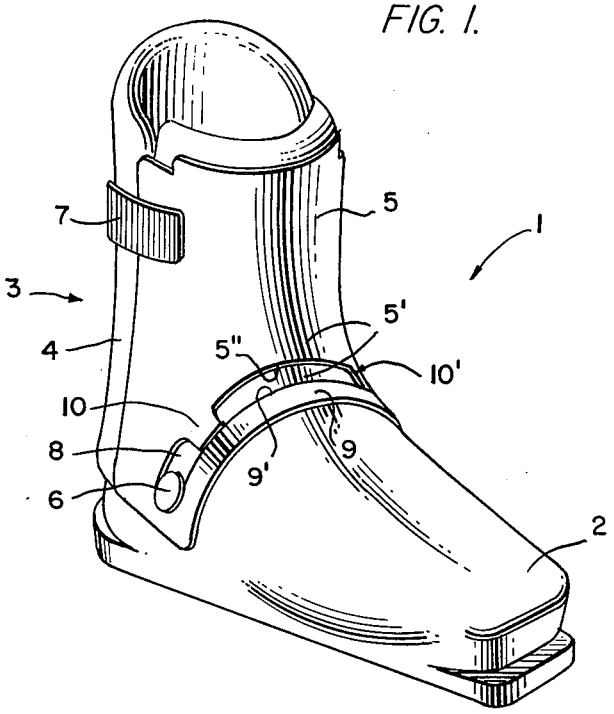
FIG. 1 is a perspective view of a ski boot according to a first embodiment of the invention in which the groove comprises two support shoulders formed only out of front of the shank or cuff.

The boot according to the invention is of the type which is put on by inserting the foot from the rear and comprises an upper portion in the form of a shank, completely surrounding the base of the leg having a front portion or cuff and a rear cowling or spoiler surrounding the rear of the base of the leg. The spoiler is journalled on the shell base in a fashion so as to allow for a tilting for opening the boot while the cuff is itself journalled on the shell base and the lower portion of the shell covers the base, particularly in the zone extending from the flexion fold to the instep. The enveloping configuration of the lower front portion of the cuff corresponds to the upper configuration of the shell base in the zone of the instep such that the cuff and the shell base overlap in a relatively sliding movement of the cuff with respect to the shell base when the leg of a skier undergoes flexional movements.

The ski boot of the invention is made out of plastic material and comprises a rigid shell base on which a shank is at least partially journalled. The lower edge of the shank cooperates with the upper surface of the shell base by means of at least one flexional element mounted transversely to the longitudinal axis of the boot over at least a portion of the circumference of the foot in a zone extending substantially from the flexional fold to the instep. The flexional element is spaced from the edge to form a transverse groove. The boot is characterized in that at least at one point along the transverse slot, the slot is interrupted by means for controlling and adjusting the support provided which assures direct contact between the lower edge of the shank and the flexional element during the flexional movements of the leg of a skier. By using a boot or shoe according to the invention, one is able to modify the deformation conditions of the shank, and more particularly of the base of the shank, with respect to the shell base. The deformation characteristics of the shank may be adapted according to the needs of the skier during skiing. This modification of the deformation conditions of the shank results in variations of the rigidity of the shank depending upon the selected positions of the force transmission shoulder on the flexional element.

According to one particular embodiment of the invention, the lower portion of the cuff comprises a slit or groove extending transversely to the longitudinal axis of the boot over at least a portion of the perimeter between the top of the flexion fold zone to the instep.

The provision of this groove thus defines a zone of narrow width in the lower portion of the cuff bordered by a lower deformable edge of the cuff. In this embodiment, the transverse slit or groove is penetrated transversely by a projecting portion of either the cuff, or the lower flexion fold band such that this projection functions as a support shoulder of the shank on the flexion fold band. Preferably, a shoulder whose position is displaceable along the length of the groove can be positioned between the two edges of the groove. By manipulating the shoulder, the user is thus able to vary the spacing conditions of the interior edges of the groove which results in a variation of the rigidity or stiffness of the shank depending upon the selected position.

Thus, depending upon the amplitude and/or the intensity of the force resulting from a flexional movement, the support shoulder comes into more or less pronounced contact with the flexion fold band which serves to limit the approach of the interior edges of the transverse groove thereby resulting in a rigidity of the shank which is controlled by the deformation of the flexion band.

Depending upon the particular embodiment selected, various flexion control possibilities can be obtained. In effect, depending upon the position of the support shoulders, the rigidity of the shank will be more or less pronounced for a given flexion.

Various embodiments of the boot according to the invention can be realized.

According to a first embodiment, the ski boot comprises a cuff having a groove at its lower portion extending from one journal axis of the cuff on the shell base to the other substantially along the periphery of the flexion fold. The groove defines a flexion fold band which is integral with the cuff at the lower front portion of the cuff. Two projections out of the lower front portion of the cuff define a non-rectilinear contour of the upper edge of the transverse groove. The two projections, situated approximately at the middle of each side of the boot, are tangent to the lower edge of the groove and define as a result two support shoulders contacting the flexion fold band.

According to another embodiment, the flexion fold band is an added element that is secured or attached to the base of the cuff and may be made out of a material of a different type than that of the rest of the shank. Furthermore, this embodiment greatly favors the reduction of complicated machining costs relative to the cuff with the integral flexion band of the preceding embodiment.

In another embodiment a flexion band is provided which is connected directly to the shell base at its two ends. Thus, the cuff and the flexion fold band are connected to the shell base by attachment means which are independent of one another. In this embodiment, the lower front edge of the cuff no longer cooperates with the flexion fold band in a direct fashion but instead cooperates through the interposition of one or two shoulders situated at selected points of the groove formed by the cuff base and the flexion fold band.

In these various embodiments, the journal axis of the cuff, which can be imaginary or real, can be provided either exterior to the groove, or on the interior thereof at each of its lateral ends.

Finally, according to yet another preferred embodiment of the invention, the groove provided between the cuff base and the flexion fold band extends over only a portion of the periphery of the top of the flexion fold. Preferably, this groove covers only the external half of the periphery and is constituted by an opening extending from substantially the middle of the edge of the cuff base until approximately its external journal axis and with a flexion fold band constituted by a sort of contoured bar over the external half of the periphery of the flexion fold and attached to the latter by two assembly means. In this embodiment, the cuff comprises only a single support shoulder situated approximately midway along the length of the groove which is thus formed.

Furthermore, assembly means are provided which may be removable or not, and are positioned respectively at each of the ends of the bar i.e., substantially in the zone of the apex of the instep and in the proximity of the external journal axis. This embodiment has the advantage of not being subjected to being kicked on the internal surface of the boot during skiing by the metal reinforcement of the other boot. Likewise, this construction can be provided with rear support retention means positioned in the recess of the cuff base. Finally, in this preferred embodiment, provision is made for the possibility of interchanging the flexible fold band with other such bands which may differ in configuration and/or cross-section, or be of different materials which have different flexion coefficients depending upon the needs of the user.

Likewise, it is always possible, without going beyond the scope of the invention, to form boots whose shoulder supports are integral, not with the base of the cuff, but with the flexion band itself.

Along the same lines, an improvement of the system according to the invention comprises the use of support shoulders which are independent of the material of the cuff base or of the flexion band. Thus, in this improved version of the invention, and depending upon the embodiment and the possibilities of adjustment which one wishes to obtain for a finer modulation of the flexional characteristics, the groove can be provided with two movable shoulders or cursors which are movable independently of one another such that it is possible to create flexion conditions such that the skier obtains an orientation of the flexional forces with respect to the longitudinal axis of the boot, for example in the case of skiers having a morphological leg problem.

Different embodiments of the boot according to the invention can likewise be envisaged. According to one embodiment of the invention, the ski boot comprises a cuff having a groove at its lower portion extending from one to the other of the journal axes substantially along the periphery of the flexion fold. The groove in effect defines a flexion fold band at the lower front portion of the cuff which is an integral portion of the cuff. Two cursors are positioned in the groove and can be moved translationally in the groove independently of one another. The displacement of the cursors thus modifies the approach relationship of the edges of the groove, and consequently, the deformation conditions of the lower rim the cuff and of the flexion fold band in response to flexions of the user.

In another embodiment, the flexion fold band is a separate element and is connected and assembled at the base of the cuff. This embodiment may be dictated by manufacturing considerations (simpler mold and easier molding of the cuff and of the flexion fold band). Furthermore, this embodiment makes it possible to utilize materials of a different nature to increase the range of flexional characteristic variations which are possible.

In another embodiment a flexion fold band is provided, as in any of the previous embodiments, but whose central portion is eliminated thus resulting in an interruption substantially at the upper edge of the instep. The lateral arms of the flexion fold band are nevertheless attached to the shell base in the vicinity of the upper edge so as to furnish a support for the cursors.

For all of these embodiments, the journal axis of the cuff, which can be imaginary or real, can be provided either outside of the groove or on the very interior thereof at each of its lateral ends.

According to another embodiment, the flexional fold band which is itself connected at its two ends to the shell base is no longer connected to the cuff which is itself also journalled on the shell base by linkage means independent of those of the band. In this embodiment, the lower front edge of the cuff cooperates with the flexion fold band only through the interposition of one or more cursors positioned in the groove formed between the base of the cuff and the flexion fold band.

According to yet another embodiment, a groove is provided directly between the bottom of the cuff and a shoulder zone running along the shell base in the instep zone. At least one cursor made out of elastic material is positioned in this groove. Furthermore, it is likewise possible to provide an adjustment means for adjusting the flexional characteristics by combining any of the embodiments briefly enumerated above with the instant embodiment.

So as to improve the utility of ski boots comprising any of the flexion adjustment devices according to the invention, these boots can preferably comprise, with reference to the prior art described, retention means assuring security against the rear support forces independent of the flexional adjustment means. Finally, in those embodiments utilizing the shell base itself to form the groove, it is likewise possible to configure the internal edges of the groove such that the cursor likewise functions as a rider between the two parts of the boot so as to assure the security to the rear supports.

In another preferred embodiment according to the invention, the groove provided between the base of the cuff and the flexion fold band extends over only a portion of the perimeter of the top of the flexion fold. Preferably, this groove covers only the external half of the perimeter and is constituted by a cut-away portion extending from substantially the middle of the edge of the bottom of the cuff until the proximity of its external journal axis. The flexion fold band may in effect be constituted by contoured bar over the external half of the perimeter of the flexion fold and may be attached thereto by two assembly means. These assembly means which may be removable or not are positioned respectively at each of ends of the bar, i.e., substantially at the zone of the summit of the instep and in the vicinity of the external journal axis. Just as in embodiments having fixed shoulders integral with the base of the cuff or with the flexion band, this embodiment has the advantage of not being subject to being hit by the metal of the other boot on the internal surface of the boot during skiing. Likewise, this construction can be provided with retention means of the rear supports positioned in the recess of the base of the cuff.

Finally, in this preferred embodiment, it is also possible to interchange the flexion fold band used with other bands having different configurations and/or cross-sections, or bands made of different materials which thereby have different flexional coefficients depending upon the needs of the user. Of course, all of the support shoulders, be they fixed or translationally mobile, can be provided with any means, such as contact surfaces having complimentary configurations with that of the cuff and the flexion band. Additionally, the support shoulders can preferably be separate elements secured by assemblies known in and of themselves to any part of the boot according to the invention. Following this approach, it is quite clear that the shoulders can be made out of material of a different nature than that of the cuff and/or the flexion band.

Referring now to the drawings, FIG. 1 illustrates a first embodiment in which ski boot 1 comprises a shell base 2 made out of rigid plastic material. A shank 3 is journalled onto shell base 2 and encases the bottom of the leg of the skier. This shank comprises a rear shank portion 4 called a spoiler and a front shank portion 5 called a cuff. In the case of the embodiment described, spoiler 4 and cuff 5 are simultaneously journalled along the same axes 6 and 6' situated substantially in the malleoli zone. This arrangement advantageously allows for booting by entry through the rear of the boot. Closure means in the form of a buckle 7 is provided on the upper side of the shank allowing for the tightening of the shank 3 on the lower leg of the skier. Cuff 5 thus comprises a groove 8 defining a perimeter of shell base 2 passing between axes 6 and 6' in the flexion fold zone. Groove 8 is provided in the lower anterior zone 5' of cuff 5 overlapping the shell base in the flexion fold zone and is defined respectively by lower edge 5'' of the bottom of the lower zone 5' and by upper edge 9' of flexion band 9 defined at the base of the cuff by the cutout of the groove. Two shoulders 10 and 10' extending from cuff 5' extend into groove 8 and partially block groove 8 to contact the upper edge 9' of the flexion band.

Preferably, the shoulders are positioned approximately midway from each of the lateral portions of the groove, such that they rest in a zone of greatest flex of the flexion band so as to obtain inter alia, better shock absorption between the shank on the shell base. So as to improve the guidance and retention conditions of shoulders 10 and 10', upper edge 9' is adapted such that there is an assembly of corresponding shapes and/or configurations in the contact zone of the support shoulder. Thus, the end of the support shoulders 10 and 10' could, without detracting from the invention, possess as varied configurations as desired and can have support zones which are pointed, linear, etc.

It should be parenthetically noted that although the term boot is used throughout this disclosure, is being used in its normal manner to designate a ski boot, the term should not be narrowly construed and extends to boots used in all types of skiing as well as to boots and shoes which may be adapted for use in skiing.

From the above description, the principle of operation of the flexion control apparatus of the shank of the boot according to the invention can be clearly understood. For a given maximum flexion force of the skier's leg, lower zone 5' of the cuff pivots around the journal axes 6 and 6' which results simultaneously in:

(a) tractional stretching of the flexion band 9 of the cuff on shell base 2 which serves as a rigid support. This stretch is due to the fact that edge 9' of the flexion band 9 is engages the top of the shell base 2 along its path and serves consequently to increase the contact pressures of the band 9 and to reduce to the maximum the ease of displacement on the shell base;

(b) approach of edge 5" with respect to 9" whose own displacement remains negligible with respect to shell base 2; and (c) flexion of flexion band 9 at the zone of the journal axes 6 and 6'.

Shoulders 10 and 10' in groove 8, generally in the portion of the groove corresponding to the lateral surfaces of the boot, allow for a first approach limit of edges 5" and 9" by virtue of the fact that shoulders 10 and 10' serving as supports are interpositioned between 5" and 9". There is thus a transmission of at least a portion of the flexional force exerted by the skier through shoulders 10 and 10' which results in a flexion of element 9 in the contact zones with the shoulders 10 and 10'.

Furthermore, under the effect of flexional forces exerted by the skier, lower edge 5" of the cuff goes over the shell base 2 in the flexion fold zone until its maximum approach to edge 9' of flexion band 9 with which it then at least partially mates with the contour of shell base 2 and is subjected to the displacement limitations which this mating causes. In the embodiment shown in FIG. 2, boot 11 comprises a flexion control or adjustment device according to the invention and includes a cuff 15 whose edge 15" of its lower portion 15' defines groove 18 with a flexion band 19 formed as a separate portion attached to each lower side of cuff 15' by assembly means 13. These assembly means 13 such as rivets, staples, clips, etc. can however be made disassemblable such that one can assure interchangeability and/or replacement in case of wear. Advantageously, the choice of such an embodiment makes it possible to form the cuff out of relatively rigid plastic materials such as polyurethane plastics having a nature and a behavior which is different from the materials utilized for the flexion band which must have high performance elasticity and force stabilizing qualities. To achieve this, the flexion bands are preferably made of plastic material such as acetal, polyamide, and polycarbonate resins and even of metals or light alloys.

Figure 2:
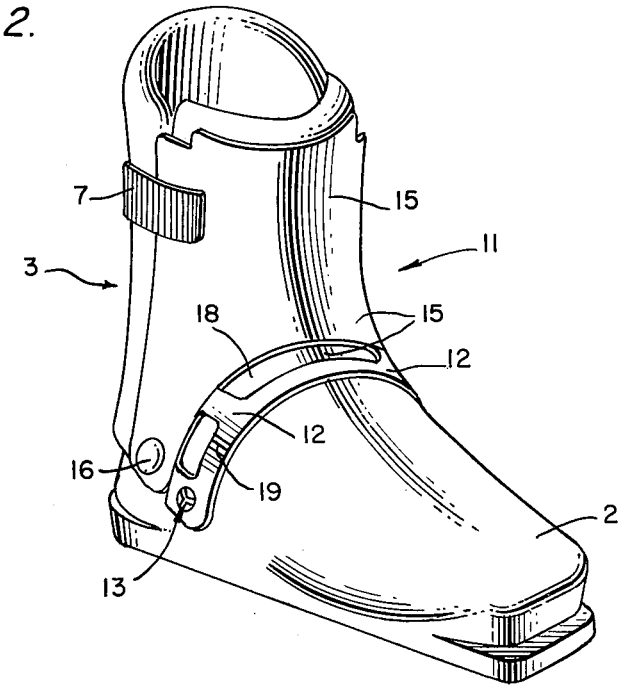
FIG. 2 illustrates a second embodiment in which the apparatus for controlling flexion includes a flexion band or strip independent of the base of the cuff, which is attached directly to the shell base, the band being provided with the two integral support shoulders.

The boot according to the invention shown in FIG. 2 has been illustrated with support shoulders 12 and 12' projecting from flexion band 19. This is only a supplemental embodiment illustrating the possibility of utilizing all of the advantages provided by the boot according to the invention with an independent flexion band. In effect, in this case, the provision of support shoulders, integral with the flexion fold band made out of plastic material and formed by molding, is easier to form than that of the cuff comprising the shoulders, if only from the perspective of the cost of machining the injection molds of these elements.

In this embodiment, the operation of the structure thus formed remains similar to that of FIG. 1 with the difference that the flexion forces of the skier are retransmitted directly from cuff 15 on shell base 2 solely through the shoulders 12 and 12' on flexion fold band 19 resting on the shell base. The shoulders still act to control the approach of the edges 15" and 19" of the groove 18. Advantageously, it is possible to construct this device by positioning linkage means 13 on both ends of band 19 along a common axis with those of 16 on both ends of the journal of the cuff on the base shell while maintaining the independence of the journal existing between elements 15 and 19. Thus, flexion fold band 19 can be provided with two ears serving as journal caps on axes 16 which are common with the cuff 15.

Figure 3:
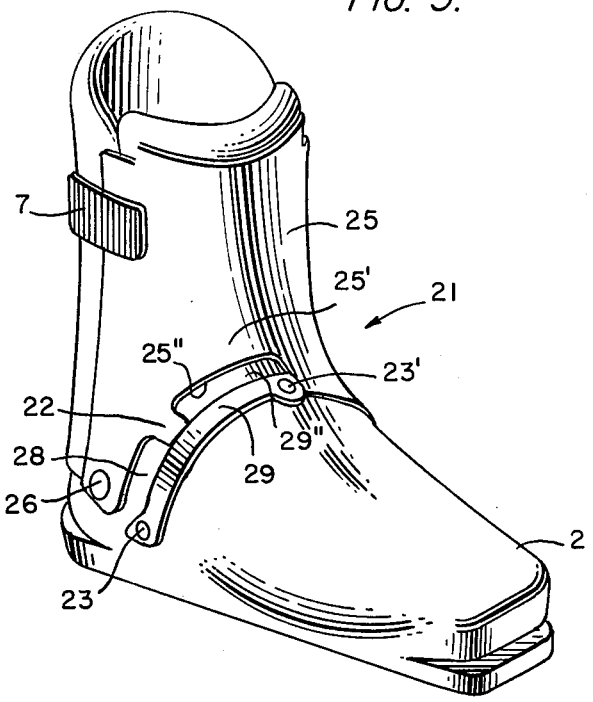
FIGS. 3 and 4 respectively illustrate third and fourth embodiments of the boot according to the invention in which the flexion band extends over only a portion of the perimeter of the zone of the flexion fold; while nevertheless illustrating respectively alternative embodiments with a support shoulder provided on the base of the cuff (FIG. 3) and an embodiment with a support shoulder extending from the flexion band (FIG. 4)

The ski boot shown in FIG. 3 comprises an apparatus for controlling the flexional characteristics according to the invention which is composed of a single support shoulder 22 between the two edges 25" and 29" of a groove 28 which is preferably provided on the external half of the periphery of the flexion fold zone. Groove 28 is defined both by a cut away portion 25' of the lower portion of cuff 25 and by flexion fold band 29 constituted by a contoured bar or strip on the half of the external perimeter of the shell base 2 substantially in the flexion fold zione. Flexion fold band 29 is attached to the base shell at each of its ends respectively by linkage or assembly means 23 and 23' which may be removable or not such as has already been described in conjunction with FIG. 2. Band 29 is attached to the shell base substantially in the zone of the apex of the instep and in the proximity of journal axis 26.

Figure 4:
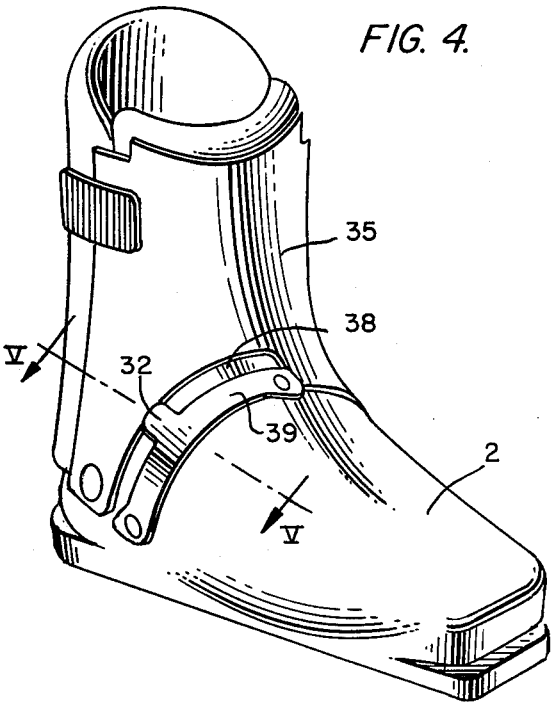

As in the case of FIG. 1, this embodiment is provided with a shoulder support 22 forming an integral portion of the cuff 25. Inversely, FIG. 4 illustrates a boot construction provided with a support shoulder 32 which is a part of flexion band 39. These two types of construction serve an identical purpose to the embodiment of FIG. 2 in which the retransmission of the flexional forces occurs directly on the partial flexion bands 29 and 39 through support shoulders 22 and 32 which interrupt grooves 28 and 38.

Figure 5:
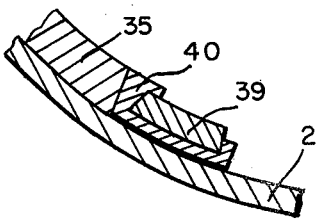
FIG. 5 illustrates a cross-sectional view of the support shoulder along line V—V of FIG. 4 provided with a wedge for adjusting the spacing of the groove.
Figure 6:
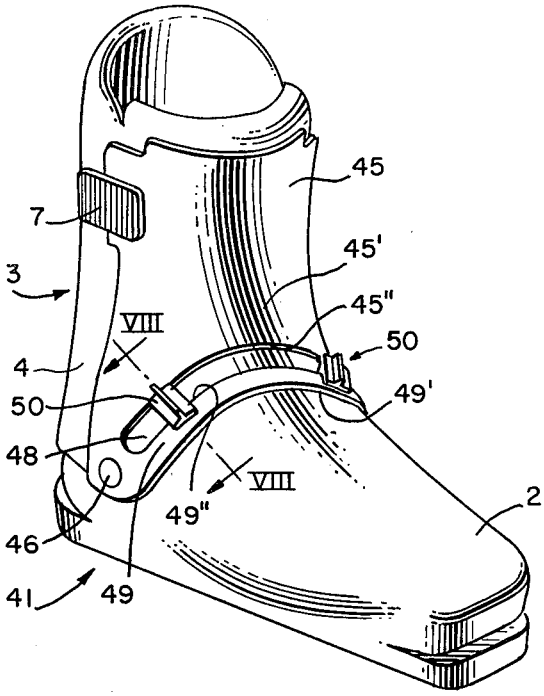
FIG. 6 is a perspective view of a ski boot according to a fifth embodiment of the invention in which the groove comprises two flexion adjustment cursors and is formed only out of the front of the shank or cuff.

So as to increase the utility of the ski boots comprising one or the other of the flexion control apparatus of the invention, the flexion control apparatus can advantageously, with respect to the art previously described, comprise retention means, assuring security with respect to rear support forces, which is independent of the flexion control apparatus. Finally, the support shoulders according to any of the embodiments, can be provided with adjustment means for adjusting the spacing of the groove between the base of the cuff and the flexion fold band as shown in FIG. 5. These adjustment means can be constituted out of rib wedges 40 or even out of removable shoulders of different lengths which can be interchanged at will depending upon the needs of the skier.

Figure 7:
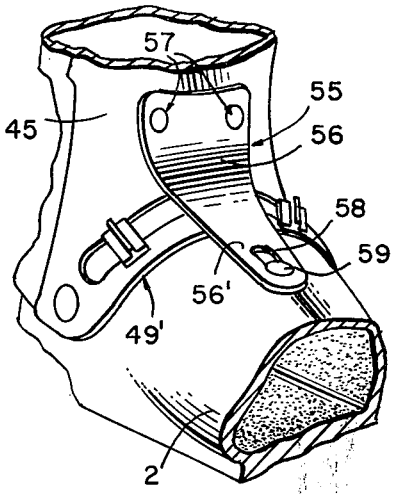
FIG. 7 illustrates a partially broken-away view, in perspective, of a ski boot according to the previous embodiment further comprising a rearward support control apparatus above the system for adjusting the flexional characteristics.
Figure 8:
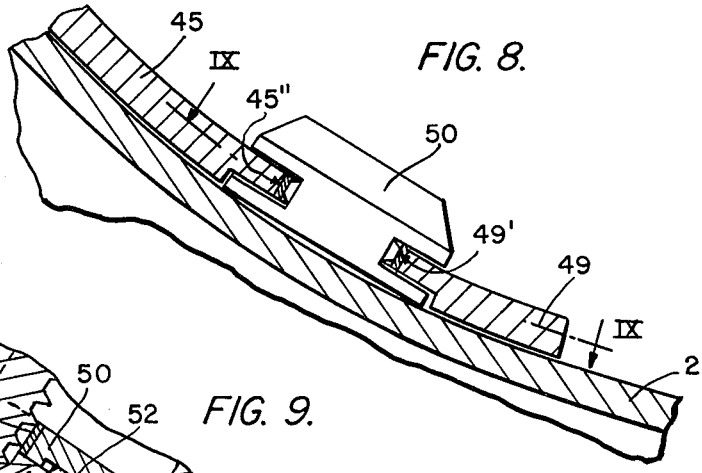
FIG. 8 is a cross-sectional view along III—III of FIG. 6 showing a cursor positioned in the groove of the device according to the invention.
Figure 9:
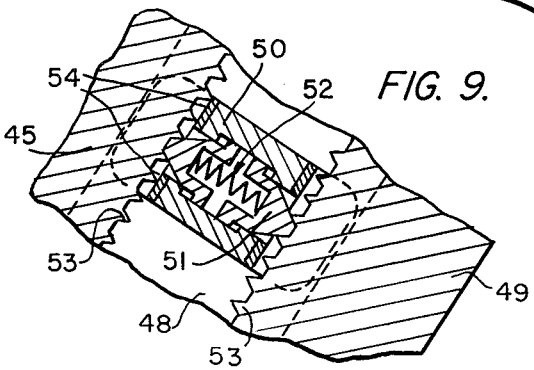
FIG. 9 is a cross-sectional view along IX—IX of FIG. 8.
Figure 10:
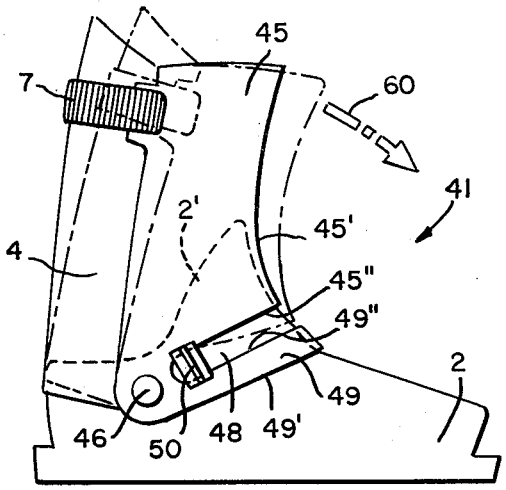
FIGS. 10 and 10A illustrate front and side elevational views of a boot according to the embodiment of FIG. 6 in the normal static position as well as in the maximum flexion position (in dashed lines)
Figure 10A:
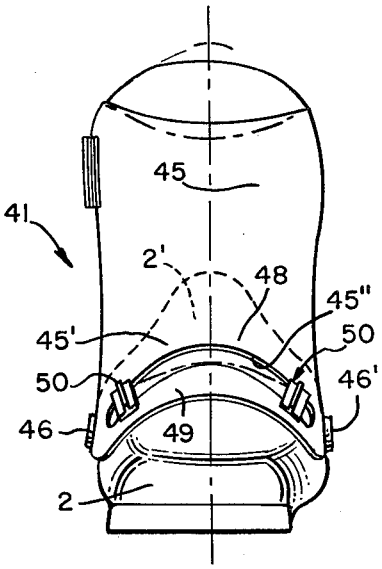

Referring to the embodiment shown in FIGS. 6–13, ski boot 41 comprise a shell base 2 made out of rigid plastic material having a shank 3 journalled thereto which surrounds and holds the leg of the skier. This shank is composed of a rear shank 4 known as a spoiler and a front shank 45 called a cuff. In the case of the embodiment described, spoiler 4 and cuff 45 are simultaneously journalled on the same axes 46 situtated substantially in the zone on the malleoli on both sides of the boot. This arrangement advantageously allows for booting from the rear of the boot. Closure means constituted by a buckle 7 is provided on the upper side of the shank assuring a tightening of the shank 3 on the lower leg of the skier. Cuff 45 comprises a groove 48 positioned along a perimeter of the shell base 2 passing between the two axes 46 in the flexion fold zone. This groove 48 is provided in the lower frontal zone 45′ of cuff 45 overlapping the shell base in the flexion fold zone and is defined respectively by lower edge 45″ of lower portion 45′ and by upper edge 49′ of flexion fold band 49 formed in the bottom of the cuff by the cutout of the groove. Two adjustment shoulders or cursors 50 which can be moved along the length of groove 48 when the user is in a normal stationary position in the boot are positioned in groove 48. So as to improve the guidance and retention conditions of cursors 50, the groove is in the form of an inverted T configuration of the tenon and mortise type, while allowing for sufficient lateral clearance for good sliding as is shown in FIGS. 8 and 9. To avoid undesired movement of the cursor 50, a ratchet 51 (FIG. 9) including spring 52 can be provided here such that the cursor remains in the selected position in the groove 48. For this purpose, the groove can be provided with small teeth 53 assuring a good engagement with ratchet 51. The operation of the cursor will, nevertheless, be assured without a ratchet system and a simple friction system can be used with the cursor 50 being provided with friction patches or zones 54 made out of soft plastic, rubber or the like.

FIG. 7 illustrates the same boot as described above but provided with an apparatus 55 for controlling rear support by assuring supplemental support of the lower leg in the rearward direction for advanced skiers, for example. For this purpose, the front of cuff 45 is provided with a tongue 56 attached substantially in the tibial support zone of the cuff by assembly means 57. Tongue 56 is contoured according to the configuration of the upper zone of the flexion fold such that the lower portion 56′ partially covers the shell base on top of the instep zone.

A slit 58 is provided in the lower portion 56′ of tongue, longitudinal to the axis of the boot, and cooperates with an adjustable pin or shoulder 59 which makes it possible to vary the inclination of shank 3.

In those two embodiments, the same principals of operation are relied upon with respect to the apparatus for adjusting the flexional characteristics of the shank of the boot according to the invention..

Thus, to obtain a position of minimum rigidity of the shank 3 with respect to the shell base 2, the cursors 50 are situated symmetrically in the immmediate proximity of the journal axes 46 and 46′ (FIG. 10) and provide only a slight resistance to the approach of the edges 45″ and 49″ of groove 48. For a given maximum flexional force of the leg of a skier, indicated by arrow 60, a pivoting of the lower zone 45′ of the cuff around the journal axes 46 and 46′ occurs which simultaneously results in:

(a) a tractional stress of the flexion fold band 49 of the cuff on shell base 2 which acts as a rigid support. This stress is due to the fact that edge 49′ of flexion band 49 is subjected to a path of movement such that it engages shell base 2 and serves to augment the contact pressures of band 49 and to reduce, as much as possible, displacement along the shell base;

(b) an approach of edge 45″ with respect to 49″ whose own displacement remains negligible with respect to the shell base; and (c) a flexion of the flexion fold band 49 beginning at the zones of the journal axes 46 and 46′.

The insertion of cursors 50 into groove 48 in the proximity of axes 46 and 46′ allows for a first limiting of the approach of its edges 45″ and 49″ by virtue of the fact that cursors 50 which act as reinforcers are wedged at this location. There is thus a transmission of at least a portion of the flexional force of the skier's leg across cursors 50 which results in a flexion of portion 49 in its contact zones with the cursors 50.

Furthermore, under the force of a flexional force exerted by the skier, lower edge 45′ of the cuff moves over the shell base 2 in the flexion fold zone 2′ until it comes into contact with edge 49′ of the flexion band 49 with which it mates.

Figure 11:
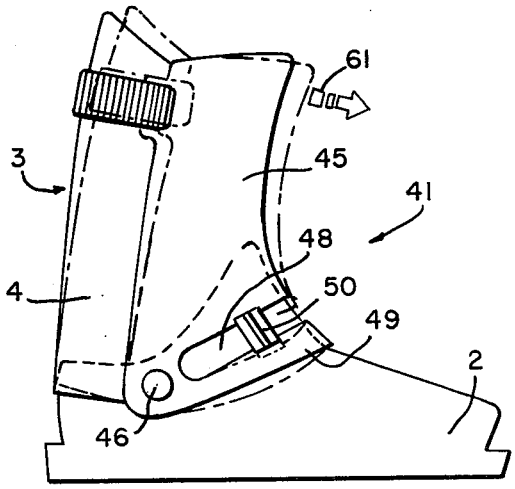
FIGS. 11 and 11A illustrate two views of the same boot as in FIG. 10 but in a position of intermediate flexion (in dashed lines)
Figure 11A:
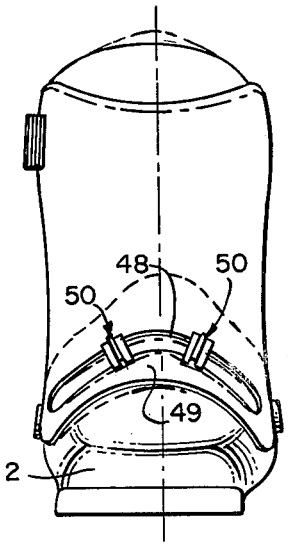
Figure 12:
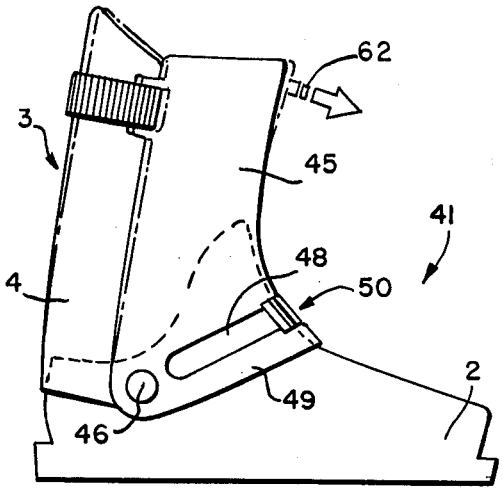
FIGS. 12 and 12A again show two views of the same boot as in FIGS. 10 and 11 in its most rigid position, the minimum flexion being illustrated for the elasticity value of the shank material (in dashed lines)
Figure 12A:
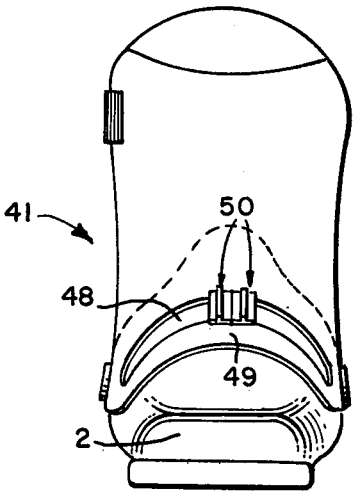

Depending upon the needs of the user, a position of intermediate rigidity of the shank 45 may be selected by moving cursors 50 such that they are positioned midway between journal points 46 and the longitudinal median plane of the boot (FIG. 11). In this figure, just as in the previously described embodiments, a flexional force exerted by the leg of a skier, illustrated by arrow 61, results here again in a pivoting of the lower zone 45′ of the cuff around the journal axes 46 and 46′. Yet, the displacement of the cursors 50 into an intermediate position of the groove immediately causes:

(a) a decrease in the possibility of approach of edges 45″ and 49″ for the zone situated between the cursors 50 in a more accentuated fashion then previously;

(b) an increase in the tensional forces of band 49 and an increase of the contact pressures between the flexion fold band and shell base 2. The tension increase in band 49 in turn results in the increase of the resistance to flexion of the lower portion 45′ of the cuff. The flexion fold band functions as a tightener and the ease of approach between edges 45″ and 49″ is further limited the more cursors 50 are spaced from the journal zones 46 and 46′. The user can thus achieve, is he so desires it, a position of maximum rigidity of shaft 45 by bringing cursors 50 to the immediate vicinity of the longitudinal median plane of the boot 41 (FIG. 12).

As a result of the above, with reference to this embodiment, a flexional force given to the leg of a skier represented by arrow 62 results in:

(a) a maximum limitation of the ease of approach of edges 45″ and 49″ of groove 48, and, simultaneously;

(b) a maximum increase of the tensional forces in the cuff base 45′ through the direct transmission of the flexion force coming from the leg of the skier, from the cuff base 45′ onto the flexion band 49 across the cursors 50. The tightening or stiffening role of band 49 increases and creates a supplemental increase in the resistance to flexion of cuff 45 with respect to shell base 2.

For the different phases of adjustment of the cursors 50, the variation in resistance to the flexion of cuff 45 with respect to shell base 2 relies upon the effects of a variation (which can be permanently selected) of the ease of approach of edges 45″ and 49″ of groove 48 and upon a modification of the positions of transmission of the flexional and/or tensional forces of the lower portion 45'' on shell base 2 by means of the cursors.

Figure 13:
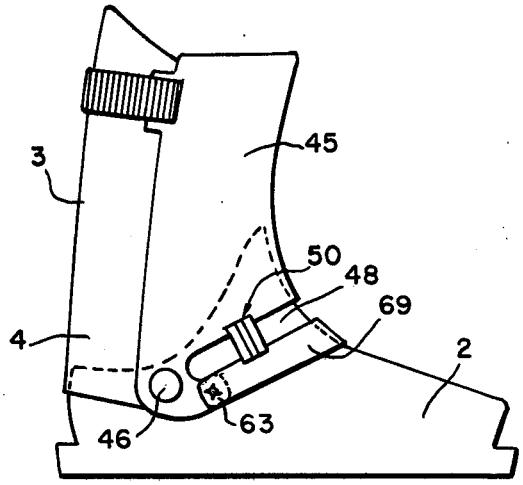
FIG. 13 shows another embodiment of the invention, in side view, operating as in the previous embodiment, with the exception that the groove is made of two distinct elements; the cuff and a flexional fold band attached to the cuff.

In the embodiment shown in FIG. 13, boot 41 comprises a flexion adjustment device according to the invention and a cuff 45 whose edge 45'' of its lower portion 45' defines the groove 48 with a flexion band 69 in the form of a separate element which is assembled on each side of cuff base 45' by assembly means 63. These assembly means 63 such as rivets, staples, clips, etc. can however be made disassemblable such that one can provide for interchangeability and/or replacement in case of wear. It is an advantage of the invention that the selection of such an embodiment makes it possible to form a cuff out of relatively rigid plastic materials such as polyurethane having a nature and a behavior which is different from materials utilized for the flexion band which must have high performance elasticity and qualities with respect to forces exerted thereon. To do this, one can preferably utilize flexion fold bands made out of plastic materials such as acetal, polyamide, polycarbonate and like resins and even metals or light alloys.

The operation of this embodiment remains similar to that of the embodiments previously described with exception of differences introduced by changes in the materials used.

Figure 15:
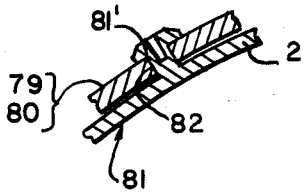
FIG. 15 illustrates a cross-sectional view of an alternative flexional fold band assembly on the shell base according to the embodiment shown in FIG. 14.
Figure 14:
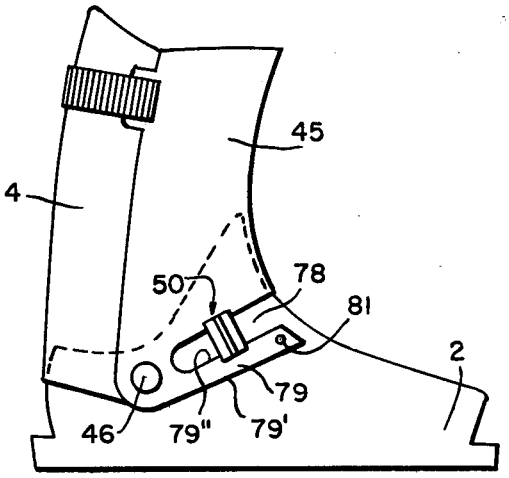
FIGS. 14 and 14A illustrate a front and side view of another embodiment which comprises, in effect, two grooves extending into one another along the periphery of the instep zone, the flexional fold band being interrupted at its middle.
Figure 14A:
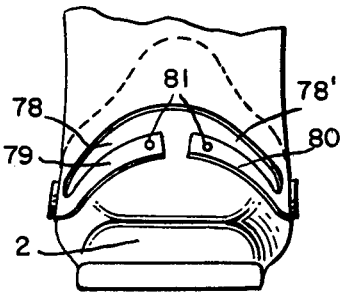

FIG. 14 demonstrates a boot comprising a flexion adjustment or control apparatus according to the invention which comprises two flexion bands 79 and 80 which define two lateral grooves 78 and 78' positioned to extend into one another along the periphery of the flexion fold zone. The inner ends of flexion fold bands 79 and 80 are connected to the shell base by assembly means 81 such as rivets, staples, or clips associated with a hole 82 mounted on a nipple 81' of the shell base 2 as illustrated in FIG. 15. In this embodiment, an increase in the flexion and/or tension resistance of the band 79 and 80 is achieved with respect to shell base 2 by virtue of the effects of cursors 50. Rigid linkage elements constituted by assembly means 81 contribute to reduce to a considerable extent the ease of displacement of the lower edges 79' and 80' of the band 79 and 80 with respect to the shell base 2 and, consequently, edges 79'' and 80'' are likewise so limited as to displacement. Cursors 50 still serve as force transmitters. The operation of this embodiment remains identical to the previous embodiments up until the zone of rigid linkage 81 with the shell base.

Figure 16:
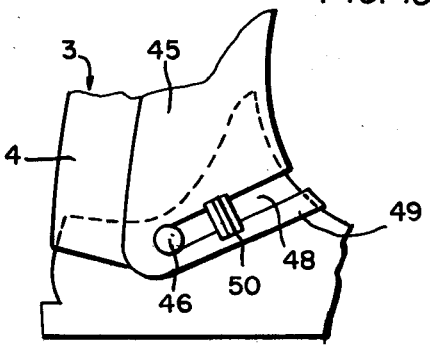
FIG. 16 is a partial side view of the details of an alternative embodiment showing the positioning of the journal axis of the cuff in the groove itself of the flexion adjustment device and which can be adapted to any of the embodiments previously disclosed.

FIG. 16 illustrates an alternative embodiment of the journal axes 46 of shank 3. In this embodiment, the end of groove 48 is centered on axis 46 itself which makes it possible to increase the length of the groove. This arrangement is adaptable to all the embodiments described in connection with the instant invention.

Figure 17:
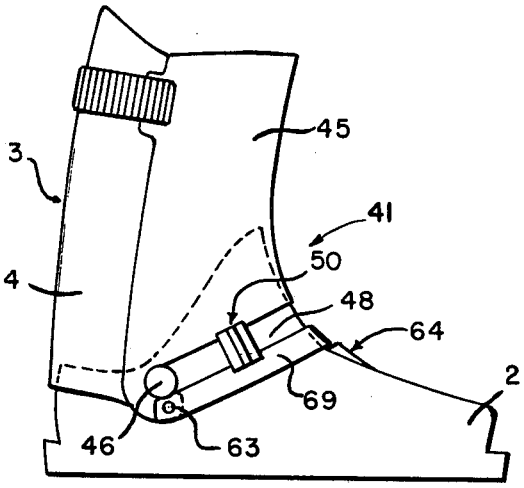
FIGS. 17 and 17A illustrate a side and front views of another embodiment combining the embodiments of FIG. 13 for the flexional fold band and FIG. 15 for the arrangement of the journal axis of the cuff, while a central shoulder stop is provided on top of the instep along the longitudinal axis of the boot.
Figure 17A:
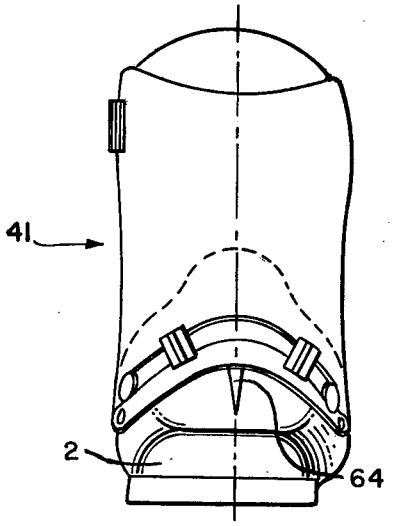

FIG. 17 illustrates an embodiment of the invention in which a separate flexion fold band 69 is secured at 63 on the bottom of the cuff which is itself journalled on axes 46 positioned directly at each of the ends of the groove 48 while flexion fold band 69 abuts a shoulder 64 of shell base 2. The operation of this is similar to that of FIG. 14 with the difference that the two assembly means 81 have been replaced by a single shoulder 64 situated in the middle of the top of shell base 2 thereby assuring by the rigid cooperation which it provides, an increase in the resistance to flexion and/or tension of flexion band 69. This increase of the resistance to the flexion occurs for a given flexion of the skier later than in the case of FIG. 14.

Figure 18:
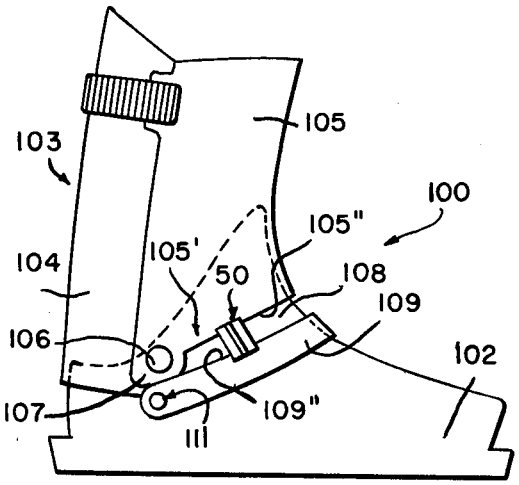
FIG. 18 illustrates side and front views of a novel embodiment in which the flexion fold band is separately attached to the cuff on the shell base to form a groove with respect to the cuff; the flexion fold band is an element independent of the cuff and is not subject to the flexional movements thereof except through cooperation with the flexion adjustment cursor or cursors.
Figure 18A:
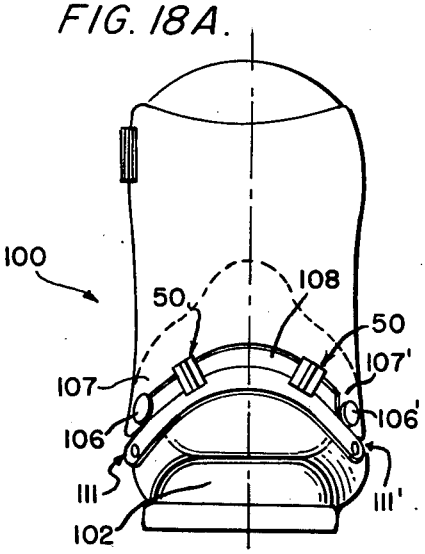
Figure 19:
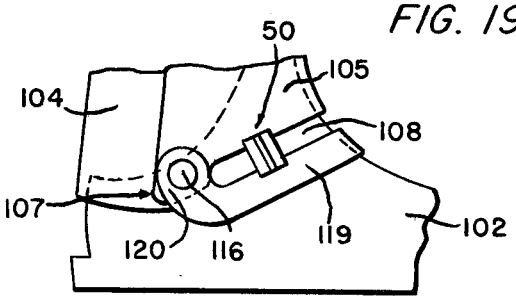
FIG. 19 illustrates a partial side view, of a modification of the previous embodiment with an alternative coaxial arrangement of the attachment means of the flexion band with respect to the base of the cuff.

FIGS. 18 and 19 show a boot 100 comprising a shell base 102 made out of a rigid material in which a shank 103 is journalled. The shank comprises a rear portion (spoiler) 104 and a front cuff 105 surrounding the lower leg of the skier. Rear spoiler 104 and cuff 105 are both journalled at axes 106 and 106'. Cuff 105 comprises two ears 107 and 107' at the location of journal axes 106 and 106'. These ears define a recess 105' at the lower portion of the cuff whose edge 105'' defines the upper edge of groove 108. The other edge (fold lower edge) 109'' of the groove is formed by a flexion band 109 which is independent of, but secured to, the cuff base, contrary to the embodiments previously described, and which is laterally attached on each side of the shell base 102 by assembly means 111 and 111' which may be removable or not. The flexion fold band 109 is otherwise independent of the cuff but for the presence of cursors 50 which slide in groove 108 and assure cooperation between cuff 105 and band 109.

In this embodiment the flexional forces of the skier are retransmitted directly from cuff 105 onto shell base 102 solely through cursors 50 on flexion band 109 resting on the shell base. The cursors still function in the same manner to vary the approach of edges 105'' and 109'' of groove 108. This embodiment further makes its possible to improve the conditions under which the device for adjusting the rigidity according to the invention is fabricated and does not necessitate complicated molds to form the cuff. Finally, as in the embodiment of FIG. 13; it is possible to proceed to the interchangeability of the flexion fold band which will be available in various models having different characteristics and materials. Advantageously (FIG. 19), it is possible to construct this apparatus by making the linkage means 111 and 111' of band 119 coincide with those of 106 and 106' of the journal of the cuff on the shell base while maintaining the independence of the journal existing between elements 105 and 119. Thus, flexion band 119 is itself also provided with two ears 120 acting as journal caps to axis 116 which is common to cuff 105.

Figure 20:
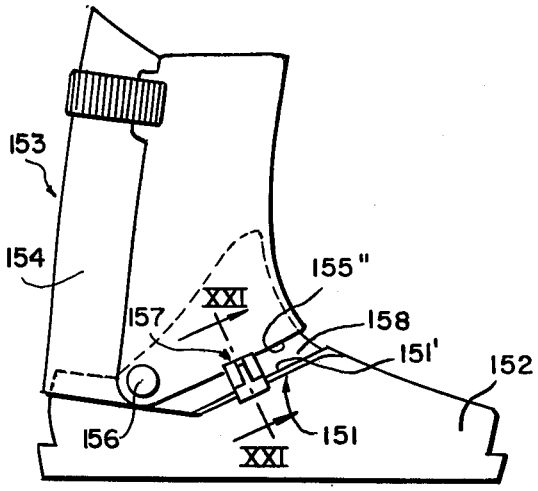
FIG. 20 illustrates a side view of yet another novel embodiment according to the invention in which the flexion adjustment device comprises a groove formed by the edge of the base of the cuff of the boot and a rib or upper shoulder of the shell base and at least one manueverable cursor positioned within the groove, having a certain compressional elasticity.
Figure 21:
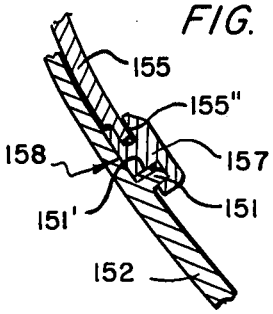
FIG. 21 is a cross-sectional view of the cursor along XXI—XXI of the previous embodiment showing its guidance which is assured respectively beneath the cuff and on the rib of the shell base.
Figure 22:
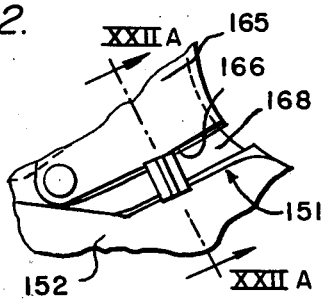
FIG. 22 is a perspective view of one embodiment of the groove and cursor according to the principal of construction of FIG. 20 in which the cursor, likewise shown in cross-section in FIG. 22A, simultaneously controls frontward flexion and provides rear support control of the shoe shank according to the invention. The adjoining cross-section shows the detail of the edges of the groove and of the anchorage of the cursor thereon.
Figure 22A:
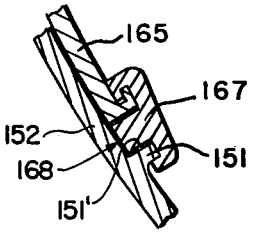

FIGS. 20–22 illustrate another embodiment which is a variation of the previous embodiment and which comprises a simplified arrangement of the groove positioned between the cuff at the front of 155 of shank 153 and shell base 152 of boot 150. Groove 158 is formed by a single lower edge 155'' of cuff 155 which is spaced from a relief configuration 151 provided on the upper surface of shell base 152 along the instep zone. Cursors 157 are wedged in this groove and slide between its upper edge 155'' and lower edge 151' and serve to limit, depending upon the position which they occupy along groove 158, the approach of the edges 155'' and 151'. Relief configuration 151 which is an integral part of shell base 152 is, itself, relatively rigid and does not deform except to a very slight extent. It is also necessary to provide one or more cursors 157 made out of a more elastic material than the shell base which can be compressed.

FIG. 21 illustrates a cross-sectional view of the embodiment of FIG. 20. As may be seen, relief configuration 151 is raised and fits into a matching track provided in cursor 157. The cursor is further cut out so as to accommodate edge 155''.

FIG. 22 illustrates a particular embodiment where groove 168 comprises two raised edges 166 and 151 on cuff base 165 and shell base 152 respectively. These two edges likewise assure support against rearward flexion by virtue of the one or more cursors 167 which engage both sides of the shoulders. As a result, cursors 176 are subjected to compression as well as to extensional forces.

Figure 23:
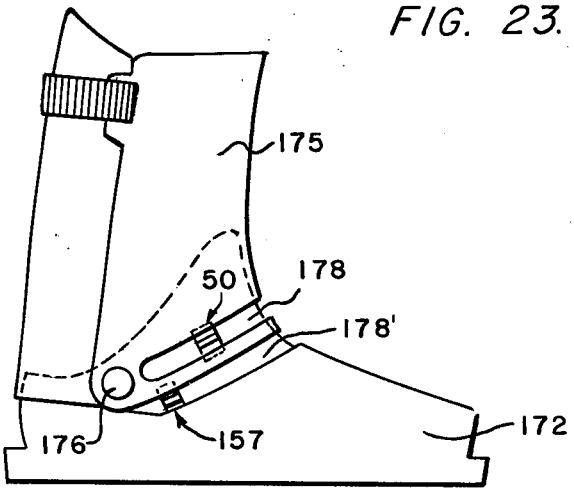
FIG. 23 is a side view of an alternative embodiment comprising two different grooves each having at least one cursor, thereby combining feautres arrangements of FIGS. 6 and 20.

FIG. 23 illustrates an embodiment of the invention which combines two grooves 178 and 178' which are substantially parallel to one another and which allow for a greater capacity to modulate the rigidity variations of cuff 175 by maneuvering cursors 50 and/or 157 separately or simultaneously. The structure of this embodiment may rely also upon the same techniques of construction previously described, for example, in FIGS. 6 and 20.

Figure 24:
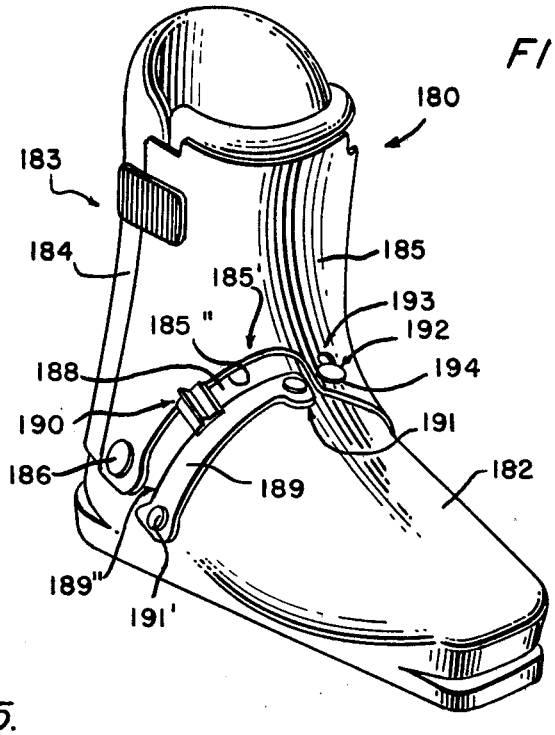
FIG. 24 is a perspective view of another embodiment of a boot according to the invention in which the groove extends over only half of the perimeter of the zone from the flexion fold to the instep on the external side of the boot.

Ski boot 180 shown in FIG. 24 comprises an adjustment device for adjusting the flexional characteristics according to the invention. The boot comprises a single cursor 190 which is movable in a groove 188 which is advantageously provided on the external half of the periphery of the flexion fold. Groove 188 is defined by a cutout 185' on the lower portion of cuff 185 and by a flexion fold band 189 constituted by a curved or contoured bar mounted substantially along the half of the flexion fold periphery which is external to the shell base 182 substantially in the flexion fold zone. Flexion fold band 189 is attached to the shell base at each of its ends by assembly means 191 and 191' respectively which may be disassemblable or not such as has already been described in FIG. 18. The assembly zones of the shell base are situated substantially in the zone of the summit of the instep and in the vicinity of journal axis 186.

So as to control the rear supports, a rear retention shoulder 192 is provided in the uncutaway zone of cuff base 185 and is constituted by an oblong slit 193 positioned substantially along the longitudinal axis of the boot and sliding on a nipple 194 integral with the shell base. To improve the ease of adjustment of the rigidity of the shank, nipple 194 can receive a height adjustment means (e.g., a thread) (not shown) such that one can increase the frictional coefficient between the cuff 185 and the shell base in their contact and recovery zone. Otherwise, such as was explained above, e.g. FIG. 21, band 189 contains an opening along its surface facing the shell base in a manner so as to facilitate the sliding of the cursor 190 in the groove.

Figure 25:
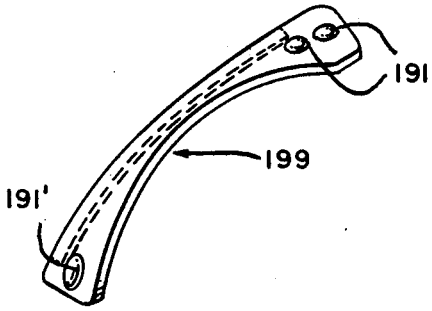
FIGS. 25–27 are perspective views of three alternative embodiments of the flexion fold band of the boot shown in FIG. 24.
Figure 26:
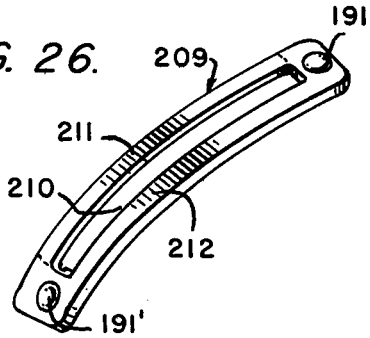
Figure 27:
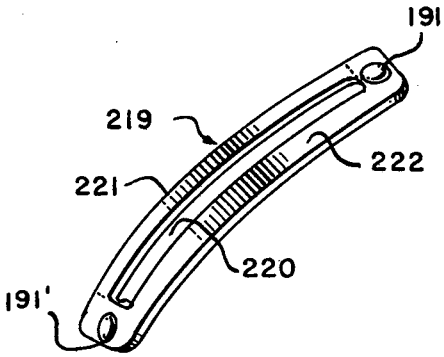

Groove 188 can advantageously be formed by flexion bands having variable configurations and cross-sections (FIGS. 25–27). Thus, as seen in FIG. 25, flexion band 199 comprises approximately in its median portion, a section of lesser width which allows for greater flexion for the skier. Flexion fold band 199 preferably comprises two anchorage points 191 for securing the band to the shell base which are situated at its upper (inner) end. This particular arrangement makes it possible, during flexional bias by the skier, to increase the purely flexional possibilities of band 199 and to diminish the extent of friction on the shell base during its deformations caused by forces transmitted through cursor 190.

FIGS. 26 and 27 illustrate another embodiment of the invention flexion fold bands 209 and 219. These bands are longitudinally cut by slots 210 and 220 which serve to define two arms 211 and 212, and 221 and 222, respectively for each of the bands. In the case of band 209, arms 211 and 212 are of identical width while for band 219, arms 221 and 222 have different widths resulting from the variable cross-sectional volume of cut-away portion 220. The advantage of this embodiment resides in the feet that arm 221 of band 219 has a variable cross-section which decreases from top to bottom which results in a more progressive flexion than in the case of band 209. Nevertheless, in the embodiments of both figures, bands 209 and 219 make it possible to achieve a better elasticity of the shank under flexional bias of the skier. In effect, during such bias, arms 212 and 222 come into contact with the shell base and frictionally engage one another until the arms lock with the shell base as a result of their engagement as they move. This blockage of arms 212 and 222 serves to lift up arms 211 and 221 from shell base 182 which results in arms 211 and 221 being subjected to purely flexional forces as a result of the forces transmitted through cursor 190.

Figure 28:
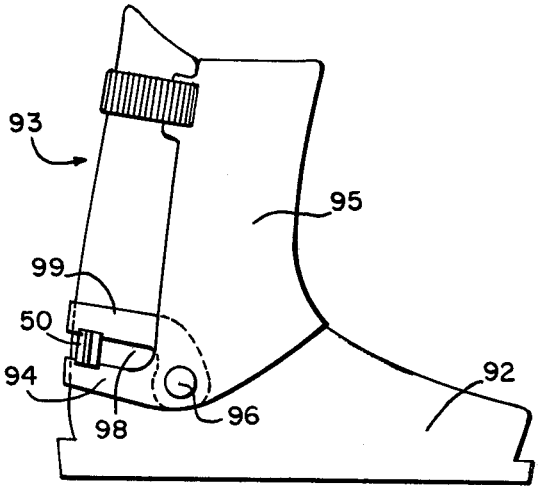
FIG. 28 illustrates the possibility of adapting the rigidity adjustment apparatus of the shank to the rear zone of the lower perimeter of the shank.

Finally, it is possible to adapt the apparatus for adjusting the rigidity of the shank with respect to frontward flexions in the rear zone of the lower periphery of shank 93 which may be seen from FIG. 28. In this embodiment, shank 93 comprises a cuff 95 provided with a stirrup 94 surrounding the rear of shell base 92 in the general vicinity of the heel. A flexion band 99 is supported on the rear of shank 93, which is integral with the shell base, and comprises a groove 98 wherein cursor 50 slides. Groove 98 extends substantially along a plane parallel to the plane of the sole in journal axis 96 of the shank of the shell base. During frontward flexion, rear stirrup 94 of cuff 95 transmits the force exerted by the skier on cursor 50 which in turn transmits the force to flexion fold band 99. The flexion fold band has a path of movement which causes it to engage the rear of the shell base and cooperates therewith so as to flex in the direction of the cursor which induces a certain elasticity which modifies the rigidity of the shank.

Although the invention has been defined with respect to particular means, materials and embodiments, it is to be understood that the inventions is not limited particularly to the embodiments disclosed and that other means, materials and the like may be used without going beyond the scope of the invention as defined by the claims. Thus, it is possible to vary certain functional characteristics such as, for example, the grooves provided may have edges which are optionally parallel. Furthermore, materials very different from those disclosed may likewise be used depending upon the needs of the skier, such materials including metal, plastic materials, rubber and the like.

What is claimed is:

1. A ski boot comprising a shank and a rigid shell base, and flexion means for exerting flexional forces from said shank on said shell base, said flexion means being generally positioned at the lower portion of said shank and comprising:

(a) first support means associated with said shank;

(b) second support means associated with said shell base wherein said second support means comprises a flexion fold band, said first and second support means forming at least one groove therebetween; and (c) transmission means for transmitting flexional forces exerted by the leg of a skier on said shank from said first support means to said second support means.

2. The ski boot as defined by claim 1 wherein said first support means comprises a first support surface associated with said shaft and wherein said second support means comprises a second support surface spaced from said first support surface so as to define said groove therebetween.

3. The ski boot as defined by claim 2 wherein said first and second support surfaces are each arranged substantially parallel to one another.

4. The ski boot as defined by claim 3 wherein said second support means is constituted by a flexion fold band comprising said second support surface, said groove being formed between an edge associated with said shank on said first support surface and an edge of said flexion fold band.

5. The ski boot as defined by claim 4 wherein said force transmission means is adapted to transmit the flexional forces exerted by said shank on said flexion fold band.

6. The ski boot as defined by claim 5 wherein said flexion fold band is mounted substantially transversely to the longitudinal axis of said ski boot.

7. The ski boot as defined by claim 1 wherein said force transmission means comprises a support shoulder fixed at a point along said groove so as to assure direct contact between said first and second support means.

8. The ski boot as defined by claim 7 wherein said support shoulder is integral with said first support means.

9. The ski boot as defined by claim 7 wherein said support shoulder is integral with said second support means.

10. The ski boot as defined by claim 1 wherein said force transmission means is a support shoulder adapted to be slidable along said groove whereby the extent of flexional forces transmitted from said shank to said second support means can be regulated by the user.

11. The ski boot as defined by claim 10 wherein said shoulder support comprises a contact surface through which said flexional force is transmitted to said second support means.

12. The ski boot as defined by claim 11 wherein said contact surface is generally pointed.

13. The ski boot as defined by claim 11 wherein said contact surface is generally linear.

14. The ski boot as defined by claim 1 wherein said force transmission means comprises a support shoulder of adjustable length whereby the height of said support shoulder has a dimension which may be varied along the width of said groove.

15. The ski boot as defined by claim 1 wherein said second support means is a flexion fold band; said shank comprises a cuff; and wherein said groove is formed by a lower edge of said cuff and an upper edge of said flexion fold band integral with the base of said cuff.

16. The ski boot as defined by claim 1 wherein said second support means is a flexion fold band; said shank comprises a cuff at the front thereof; and wherein said groove is formed by a lower edge of said cuff and an upper edge of said flexion fold band separate from said cuff and secured thereto by flexion fold band attachment means.

17. The ski boot as defined by claim 1 comprising two of said grooves opening into one another on said shell base along the flexion fold of a skier's leg.

18. The ski boot as defined by claim 17 wherein said second support means is a flexion fold band; said shank comprise a cuff; and wherein each of said grooves is bordered by a lower edge of said cuff and an upper edge of each of said two flexion fold bands, each of said two flexion fold bands extending from a journal axis of said shank on said shell base to a zone generally above the instep of the foot where each of said flexion fold bands is secured to said shell base while defining a free zone at the top of said shell base.

19. The ski boot as defined by claim 1 wherein said shank comprises a cuff and said cuff is journalled on said shell base at at least one journal point positioned in at least one end of said groove.

20. The ski boot as defined by claim 1 wherein said second support means is a flexion fold band; said shank comprises a cuff; and said groove is formed by a lower edge of said cuff and an upper edge of said flexion fold band integral with said shell base.

21. The ski boot as defined by claim 19 further comprising retention means at each edge of said groove, and wherein said force transmission means comprises a support shoulder cooperatively associated with each of said edges of said groove to resist frontward and rearward flexion of said shank relative to said shell base.

22. The ski boot as defined by claim 1 wherein said second support means is a flexion fold band; said shank comprises a cuff at the front of said shank; and wherein said groove is formed by a lower edge of said cuff and an upper edge of said flexion fold band securely attached to said shell base by assembly means independent of said shell base.

23. The ski boot as defined by claim 22 wherein said assembly means have a pivot axis in common with the journal axis of said cuff on said shell base.

24. The ski boot as defined by claim 1 wherein said second support surface is positioned on a flexion fold band extending over only the exterior lateral portion of said ski boot.

25. The ski boot as defined by claim 1 wherein said first support means comprises a first support surface on the lower edge of said shank and said force transmission means comprises a support shoulder integral with a lower edge of said shank, said support shoulder being oriented downwardly on said boot.

26. The ski boot as defined by claim 1 wherein said second support means is a flexion fold band; said force transmission means comprises a support shoulder; and wherein said second support means is positioned on said flexion fold band, said support shoulder being integral with said flexion fold band and being oriented generally upwardly on said boot.

27. The ski boot as defined by claim 1 wherein said force transmission means comprises at least one shoulder support, and at least one of said shoulder supports is positioned approximately in the middle of at least one lateral portion of said groove.

28. The ski boot as defined by claim 1 wherein said second support means is a flexion fold band, said shank comprises a cuff journalled on said shell base on the external and internal sides of said shell base; and said groove extends from approximately the middle of the flexion fold to the external journal axis of said cuff on said shell base, said groove being formed between a cut-out portion at the base of said cuff forming said first support means and the upper edge of said flexion fold band extending substantially parallel to said cut-out zone from said external journal axis to the middle of said flexion fold.

29. The ski boot as defined by claim 26 wherein said transmission means comprises a slidable support shoulder adapted to be moved within said groove and means for securing said flexion fold band to said shell base in a removable fashion whereby said flexion fold band may be interchanged by the user.

30. The ski boot as defined by claim 29 wherein said flexion fold element is a band made of rigid elastic material of variable configuration and cross-section.

31. The ski boot as defined by claim 29 wherein said flexion fold band is cut-out so as to form two arms of equal cross-section.

32. The ski boot as defined by claim 29 wherein said flexion fold band is cut-out so as to form two arms of variable and unequal cross-section.

33. The ski boot as defined by claim 32 comprising a generally longitudinal space between each of said arms.

34. The ski boot as defind by claim 1 wherein second support means comprises at least two grooves, each of said grooves being arranged substantially in parallel, each of said grooves comprising at least one force transmission means.

35. The ski boot as defined by claim 1 wherein said flexion control means is positioned at the rear of said shank in the general vicinity of the malleoli and wherein said first support means, comprising a first support surface, are positioned at the rear of said shank and said second support means, comprising a second support surface, is associated with the rear of said shell base.

36. The ski boot as defined by claim 35 wherein said shank comprises a spoiler at the rear thereof and wherein said first support means is associated with said spoiler.

37. The ski boot as defined by claim 36 wherein said second support means comprises a flexion fold band and wherein said force transmission means comprises a support shoulder adapted to slide in said groove.

38. The ski boot as defined by claim 1 wherein said groove has a cross-section in the general configuration of an inverted T, said groove being adapted to maintain said force transmission means against said shell base.

39. The ski boot as defined by claim 38 wherein said force transmission means comprises a cursor slidably fit within said groove.

40. The ski boot as defined by claim 1 wherein said force transmission means comprises at least one support shoulder, said support shoulder being in the form of a cursor whose position may be adjusted by hand within said groove.

41. The ski boot as defined by claim 1 wherein the edges of said groove comprise a series of teeth, and wherein said force transmission means is a cursor adapted to move within said groove, said teeth being adapted to maintain said cursor in a given position set by the user.

42. The ski boot as defined by claim 41 wherein said cursor comprises at least one spring biased ratchet adapted to cooperate with said teeth.

43. A ski boot comprising a shank and a rigid shell base, said shank being at least partially journalled on said shell base, and flexion means for adjusting the flexional characteristics of said shank relative to said shell base, said flexion means being generally positioned at the lower portion of said shank and comprising:

(a) first support means associated with said shank;

(b) second support means associated with said shell base, said first and second support means forming at least one groove therebetween; and (c) transmission means for transmitting flexional forces exerted by the leg of a skier on said shank from said first support means to said second support means, wherein the position of said transmission means is adjustable along the length of said groove.

44. A ski boot comprising a shank and a rigid shell base, said shank being at least partially journalled on said shell base, and flexion means for adjusting the flexional characteristics of said shank relative to said shell base, said flexion means being generally positioned at the lower portion of said shank and comprising:

(a) first support means associated with said shank;

(b) second support means comprising a flexion fold band on said boot, transverse to the longitudinal axis of said boot, said first and second support means forming at least one groove therebetween; and (c) transmission means for transmitting flexional forces exerted by the leg of a skier on said shank from said first support means to said second support means.

45. The ski boot of claim 1, wherein said flexion means comprises means for controlling the flexional characteristics of said shank relative to said shell base.

46. A ski boot comprising a shank, and a rigid shell base, said shank being at least partially journalled on said shell base, and flexion means for exerting flexional forces from said shank on said shell base, said flexion means being generally positioned at the lower portion of said shank and comprising:

(a) first support means associated with said shank;

(b) second support means associated with said shell base, said first and second support means forming at least one groove therebetween, said at least one groove being generally positioned on the side of said boot; and (c) transmission means for transmitting flexional forces exerted by the leg of a skier on said shank from said first support means to said second support means across said groove.

* * * * *